US007581411B2

(12) United States Patent
Mostello

(10) Patent No.: US 7,581,411 B2
(45) Date of Patent: Sep. 1, 2009

(54) EQUIPMENT AND PROCESS FOR LIQUEFACTION OF LNG BOILOFF GAS

(75) Inventor: Robert Anthony Mostello, Somerville, NJ (US)

(73) Assignee: AMCS Corporation, Bridgewater, NJ (US)

( * ) Notice: Subject to any disclaimer, the term of this patent is extended or adjusted under 35 U.S.C. 154(b) by 369 days.

(21) Appl. No.: 11/474,787

(22) Filed: Jun. 26, 2006

(65) Prior Publication Data

US 2007/0256450 A1 Nov. 8, 2007

Related U.S. Application Data

(60) Provisional application No. 60/798,696, filed on May 8, 2006.

(51) Int. Cl.
*F25J 1/00* (2006.01)

(52) U.S. Cl. ..... 62/606; 62/48.2; 62/611

(58) Field of Classification Search ..... 62/606
See application file for complete search history.

(56) References Cited

U.S. PATENT DOCUMENTS

| | | | | |
|---|---|---|---|---|
| 5,755,114 | A * | 5/1998 | Foglietta | 62/618 |
| 6,199,403 | B1 * | 3/2001 | Cole et al. | 62/613 |
| 6,449,983 | B2 * | 9/2002 | Pozivil | 62/613 |
| 6,530,241 | B2 | 3/2003 | Pozivil | |
| 2001/0042376 | A1 * | 11/2001 | Johnson et al. | 62/48.2 |
| 2006/0090508 | A1 * | 5/2006 | Howard | 62/613 |

FOREIGN PATENT DOCUMENTS

| | | | |
|---|---|---|---|
| WO | WO 98/43029 | A1 | 10/1998 |
| WO | WO 2005/047761 | A1 | 5/2005 |
| WO | WO 2005/071333 | A1 | 8/2005 |

OTHER PUBLICATIONS

Gerdsmeyer and Isalski; "On-Board Reliquefaction for LNG Ships", Tractebel Gas Engineering, www.tractebel.de; p. 3; Fig. 4; p. 8.
Sillars; "Liquefaction at Sea", Horizons, Issue 10, Dec. 2004, pp. 10-11; Lloyd's Register. www.lr.org/publications "Document Finder".
"EcoRel Boil-off Gas Reliquefaction Plant-Data Sheet"; www.cryostar.com/web/lng-carrier-equipment-ecorel.php.
"LNG transport-the future here today"; The Cryostar Magazine, Spring 2004, No. 3, p. 8. Cryostar France SA, Hesingue, France.
Hamworthy Gas Systems, "LNG Reliquefaction System, Moss RS (TM) Concept", www.hamworthy.com/products.

* cited by examiner

*Primary Examiner*—Cheryl J Tyler
*Assistant Examiner*—Lakiya Rogers
(74) *Attorney, Agent, or Firm*—Watov & Kipnes, P.C.; Kenneth Wator

(57) ABSTRACT

A design for equipment and process for reliquefaction of LNG boiloff gas, primarily for shipboard installation, has high thermodynamic efficiency and lower capital cost, smaller size (volume, footprint), lower weight, and less need for maintenance than systems utilizing the prior art. The main refrigerant gas compressor is reduced to a single stage turbocompressor. Optional elements include: compression of boiloff gas at ambient temperature; compression of boiloff gas in one or two stages; turboexpansion of refrigerant gas incorporating one or two turboexpanders; turboexpander energy recovery by mechanical loading, compressor drive, or electric generator; refrigerant sidestream for cooling at the lowest temperatures.

7 Claims, 6 Drawing Sheets

EQUIPMENT AND PROCESS FOR LIQUEFACTION OF LNG BOILOFF GAS

CROSS-REFERENCE TO RELATED APPLICATION

This application is entitled to the benefit of Provisional Patent Application Ser. No. 60/798,696 filed May 8, 2006.

FIELD OF THE INVENTION

The present invention is directed to the reliquefaction of boiloff vapors from liquefied natural gas (LNG) storage tanks. Such storage tanks are used on large ocean-going vessels for transport of LNG, and are in widespread use on land in many applications.

BACKGROUND ART

This invention is particularly applicable to shipboard reliquefaction of boil-off natural gas from LNG carriers, where simplicity, weight, energy consumption, cost, and maintenance must strike an economic balance.

Such systems have typically incorporated a refrigeration cycle, composed of a working fluid such as nitrogen gas in multi-stage compression and one or two turboexpanders which may drive compressors; and the boiloff gas is typically compressed in two stages. Such prior art is shown in existing patents: WO 98/43029 A1 (Oct. 1, 1998), WO 2005/057761 A1 (May 26, 2005), WO 2005/071333 A1 Aug. 4, 2005, each issued to Rummelhoff; and U.S. Pat. No. 6,449,983 B2 (Sep. 17, 2002) and U.S. Pat. No. 6,530,241 B2 (Mar. 11, 2003), each issued to Pozivil; and has also been prominently displayed in publications and web sites. The designs in the prior art include turboexpansion of the refrigerant gas through wide pressure and temperature ranges, considered essential for process efficiency under the selected overall plant design, leading to compression of the refrigerant gas in multistage compressors of increased weight and complexity. None of these patents (and other published material) has openly considered the viability of a single stage of refrigerant compression, though shipboard liquefaction of boiloff gas has been a topic of serious investigation. Hence, the advantages of single-stage compression of a refrigerant gas in a main compressor have not been obvious to practitioners with skill in the specific technology.

Since these installations are considered primarily (but not exclusively) aboard ship, size and weight, and the number of pieces of equipment, especially machinery, take on great importance. Additionally, requirements for unbroken on-stream time may necessitate full duplication of all rotating equipment, effectively doubling the savings which accrue from a reduction in component machinery and complexity.

In view of the compound requirements for achieving efficient reliquefaction and reducing the number of components, including their weights and complexity, it would be advantageous to develop a process which achieves both ends.

It has been determined that under certain design configurations, a refrigeration cycle requiring a main single-stage compressor for the refrigerant, can have high thermodynamic efficiency (low specific power); and have the aforementioned benefits of reductions in component rotating equipment.

The current invention breaks the state-of-the-art barrier to an efficient refrigeration cycle based on a low compression ratio for the refrigerant gas, and enables employment of a single-stage main compressor for the refrigerant gas. The current system offers attractive alternatives to other proposed and constructed systems.

This invention achieves the objectives of net capital cost and overall weight reduction by reducing the compression of nitrogen in a main compressor to one centrifugal stage, saving a large investment over a main compressor of multiple stages and its coolers. Further compression may take place in compressors which are shaft-connected to turboexpanders.

Another aspect of this invention is that the refrigeration cycle is so designed as to efficiently achieve boiloff gas condensation while utilizing only one turboexpander, while maintaining a low compression ratio on the single-stage refrigerant compressor.

This invention relates to a process and equipment configuration to liquefy natural gas boiloff, wherein gas machinery for the refrigeration cycle is composed of a single-stage main compressor and one or two turboexpanders, which may drive compressors.

Additional improvements may include, all or individually, a single-stage boiloff gas compressor; an inserted heat exchanger to enable compression of the boiloff gas from an ambient temperature condition; and throttling a small refrigerant sidestream at low temperature in order cover the complete cooling range, while maintaining a low compression ratio on the single-stage main cycle compressor without an increase in energy consumption. This is especially effective when the condensed boiloff gas is brought to a subcooled condition.

OBJECT OF THE INVENTION

The object of this invention is to provide equipment and process for reliquefaction of LNG boiloff gas which is thermodynamically efficient, in an installation which has a lower capital cost, smaller size (volume, footprint), lower weight, and less need for maintenance than systems utilizing the prior art.

SUMMARY OF THE INVENTION

Reliquefaction systems for liquefaction of LNG boiloff gas can be composed of a circulating working fluid, such as nitrogen in a closed cycle, which includes compression and machine expansion; as well as compression of the LNG boiloff gas. Such systems are machinery-intensive, i.e. the machinery size, weight, cost, and potential maintenance constitute major factors in the practicality and economy of the installation. This invention directly addresses machinery-intensive systems by means of a reduction in machinery components, i.e. stages of compression, while maintaining, and even improving, the energy requirements for reliquefaction.

The signal feature of the invention incorporates a single-stage main compressor for the circulating refrigerant fluid (nitrogen). Since each stage of compression in a main compressor requires an aftercooler (intercooler, if followed by another stage of compression), a reduction in stages of compression also reduces the heat exchanger requirements for cooling the compressed gas. Of course, savings are multiplied, if an installation must have a spare compressor.

Additionally, features can be incorporated in the invention which improve the thermodynamic efficiency (reduction in power consumption) of the reliquefaction process. These features include:

1. The cold boiloff gas emerging from the storage tank is warmed to approximately ambient temperature before it is compressed. Compression of cold gas has a thermodynamic penalty and leads to higher energy consumption.

2. A small refrigerant stream is liquefied, reduced in pressure, and introduced into the cold end of the main heat exchanger in order to achieve final cooling or subcooling of the reliquefied boiloff gas, as a means of reducing the overall compression ratio required for compression of the refrigerant.

The invention allows choices for employment of one or two stages of boiloff gas compression; one or two refrigerant turboexpanders; how the turboexpander(s) is loaded, i.e. by compressors, electric generators, mechanical load, and/or dissipative brakes; whether a combination of compressors is in series or parallel; if there are two turboexpanders, whether they operate in series or in parallel; and whether a turboexpander-driven compressor operates over the same pressure range as the main compressor, or a different pressure range.

BRIEF DESCRIPTION OF THE DRAWINGS

The figures show multiple versions of the invention as examples of many alternative arrangements. These configurations are not exhaustive; but serve as a sampling of many possible arrangements which can accompany the externally-driven single-stage compression of the refrigerant gas as the chief element of the process invention.

DETAILED DESCRIPTION OF THE INVENTION

Figure 1:
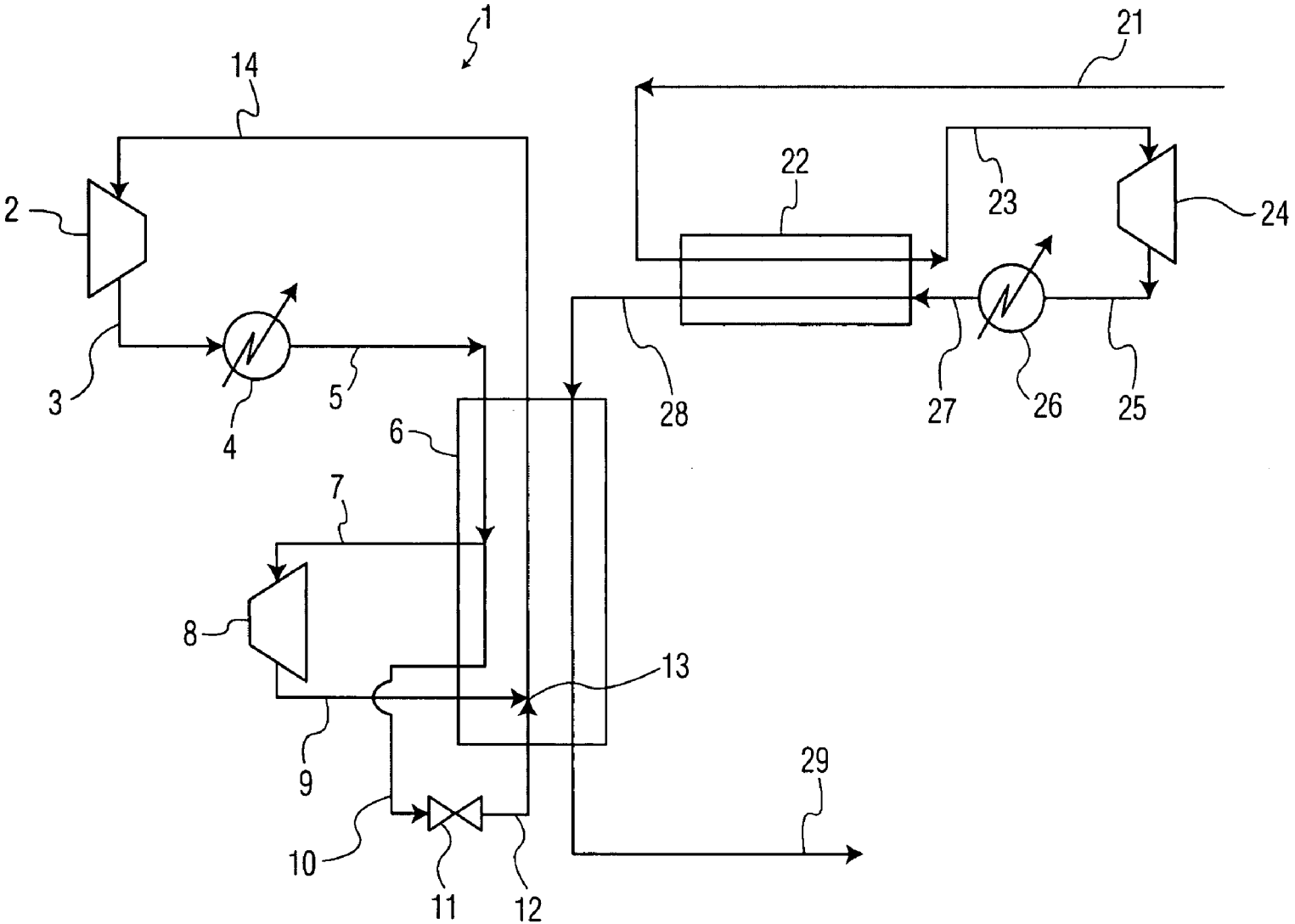
FIG. 1 depicts a version of the invention which includes a heat exchanger which recovers boiloff gas refrigeration; a single stage of boiloff gas compression; and a single turboexpander. Turboexpander shaft output could drive an electric generator, a mechanical load, or a dissipative brake.

The drawings show the arrangement of equipment for effecting this process and its modifications.

(FIGS. 1 & 2) A refrigerant cycle gas 14, such as nitrogen, is compressed in a single-stage compressor 2. Through an arrangement of heat exchangers 6 and one turboexpander 8, refrigeration is delivered to the compressed natural gas boiloff from the cargo of a liquefied natural gas carrier ship, or other liquefied natural gas storage container.

The compressed nitrogen 3 is cooled in an aftercooler 4 against cooling water or ambient air, and is partially cooled in a heat exchanger 6 against low-pressure returning streams. A first part of the partially-cooled compressed nitrogen 7 is withdrawn from the heat exchanger and is work-expanded in a turboexpander 8. The exhaust stream 9 from the turboexpander re-enters the heat exchanger 6 and flows countercurrent to the feed streams and exits as stream 14 which returns to the suction side to the aforementioned single-stage nitrogen compressor.

The second divided stream 10 is further cooled in the heat exchanger 6. It is removed and passed through a throttle valve 11 and stream 12 exits the throttle valve at the same or nearly the same pressure as the turboexpander exhaust pressure of the first divided stream. The valve-throttled stream 12 also re-enters the heat exchanger 6 and flows countercurrent to the feed streams. Stream 12 may be combined with stream 9 at junction point 13 and also returns to the suction side to the aforementioned single-stage nitrogen compressor. Power recovery from the turboexpander 8 may be by mechanical shaft connection to the single-stage nitrogen compressor or by means of an electric generator. In some cases, power recovery may not be practiced.

In FIG. 1, natural gas boiloff 21 is warmed in a heat exchanger 22 and then compressed in either a single stage compressor, or in two stages with intercooling. The compressed boiloff gas 25 is cooled in an aftercooler 26 against cooling water or ambient air, and the cooled, compressed boiloff gas 27 is then cooled in the above-mentioned heat exchanger 22 by refrigeration derived from warming the aforementioned natural gas boiloff. The cooled, compressed boiloff natural gas 28 undergoes further cooling in heat exchange against the refrigerant in heat exchanger 6. This stream 28 is further de-superheated and then partially or fully condensed. The condensate may be further subcooled. The condensate 29 is returned to the cargo tank of the vessel. The condensate 29 may be flashed to lower pressure with recycle or venting of vapor prior return of the liquid to the cargo tank of the vessel.

Alternatively (FIG. 2), the cold natural gas boiloff 23 enters the boiloff gas compressor 24 at the temperature it leaves the cargo tank piping, and the stream 25 which exits a one- or two-stage boiloff gas compressor directly enters the heat exchanger 6 for further cooling. Compressed boiloff natural gas undergoes further cooling in heat exchanger 6 against the refrigerant, where the boiloff gas is further de-superheated and then partially or fully condensed. The condensate may be further subcooled prior to cargo tank return. The condensate 29 may be flashed to lower pressure with recycle or venting of vapor prior return of the liquid to the cargo tank of the vessel.

Figure 2:
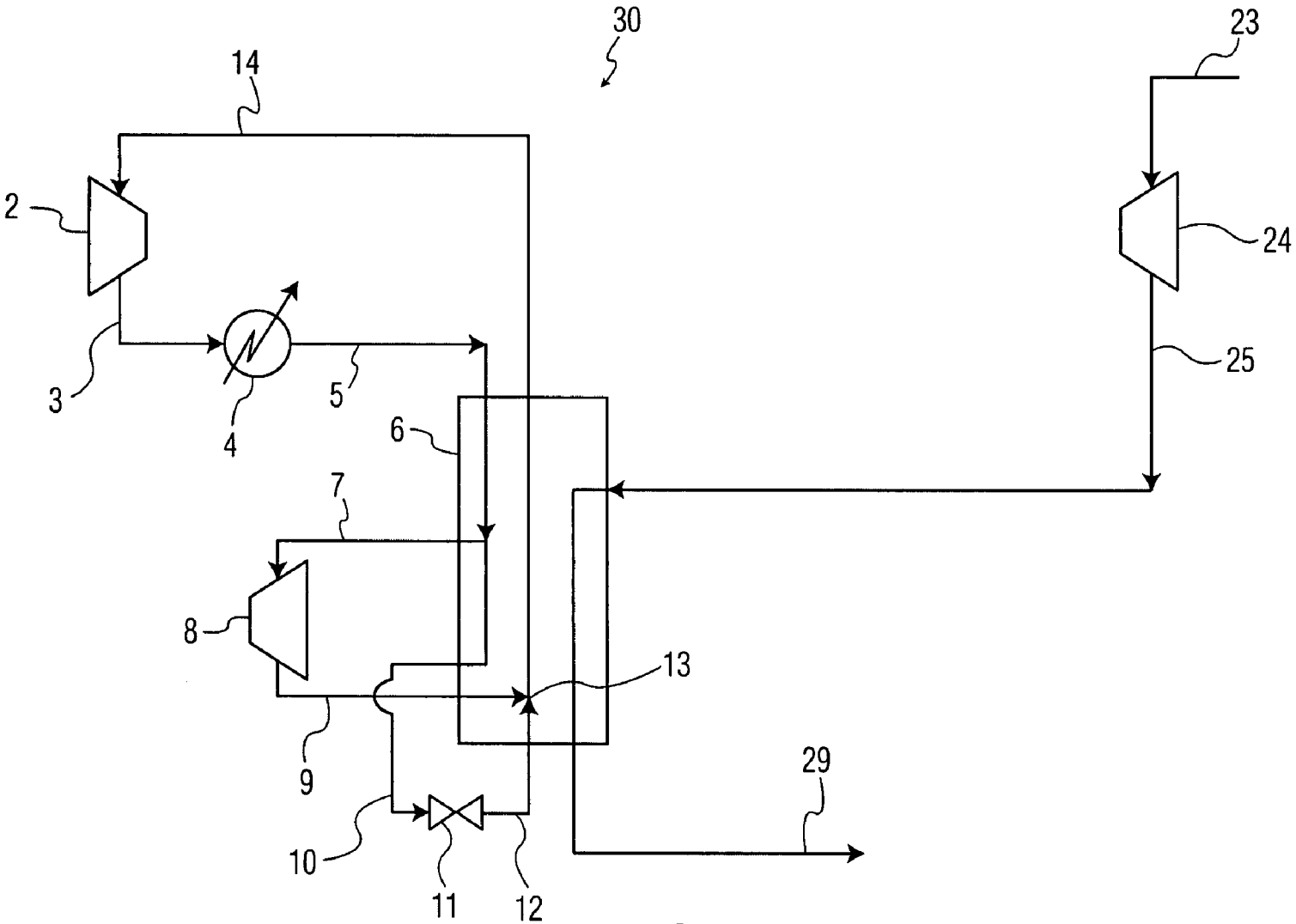
FIG. 2 depicts a version of the invention which includes a single stage of boiloff gas compression, which compresses boiloff gas as it emerges cold from the cargo tank; and a single turboexpander. Turboexpander shaft output could drive an electric generator, a mechanical load, or a dissipative brake.
Figure 3:
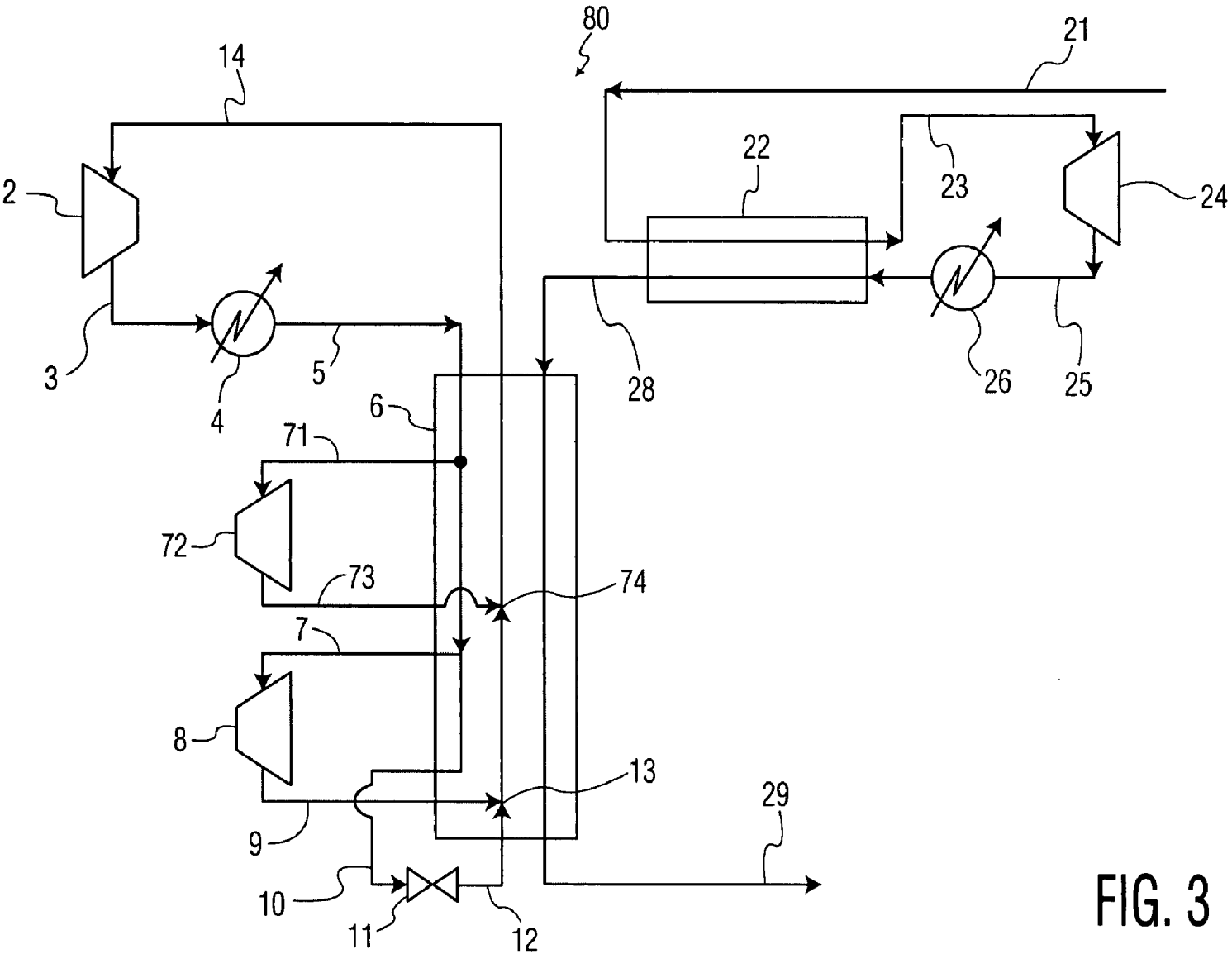
FIG. 3 depicts a version of the invention which includes a heat exchanger which recovers boiloff gas refrigeration; a single stage of boiloff gas compression; and two turboexpanders. Turboexpanders shaft output could drive electric generators, mechanical loads, or dissipative brakes. The turboexpanders are shown in a series arrangement. The turboexpanders could also be in a parallel arrangement, operating across the same pressure ratio, instead of dividing the pressure ratio between them.
Figure 4:
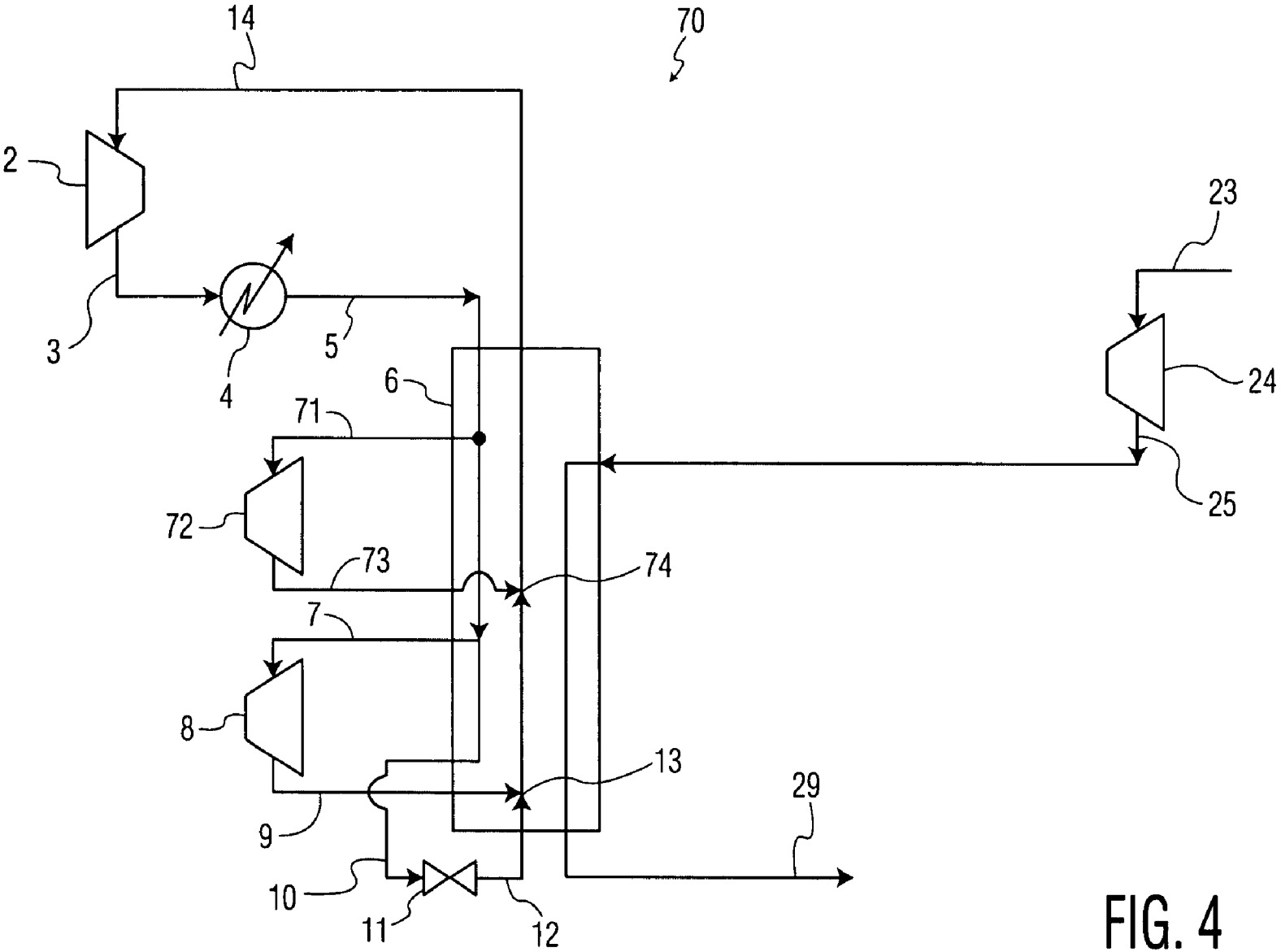
FIG. 4 depicts a version of the invention which includes a single stage of boiloff gas compression which compresses boiloff gas as it emerges cold from the cargo tank; and two turboexpanders. Turboexpanders shaft outputs could drive electric generators, mechanical loads, or dissipative brakes. The turboexpanders are shown in a series arrangement. The turboexpanders could also be in a parallel arrangement, operating across the same pressure ratio, instead of dividing the pressure ratio between them.

FIGS. 3 and 4 show arrangements similar to FIGS. 1 and 2, but incorporating two turboexpanders in the refrigeration circuit. The turboexpanders operate over different temperature ranges, which may partially overlap. These systems consume less energy than single turboexpander systems, at the cost of an additional machine and related complexity.

Figure 5:
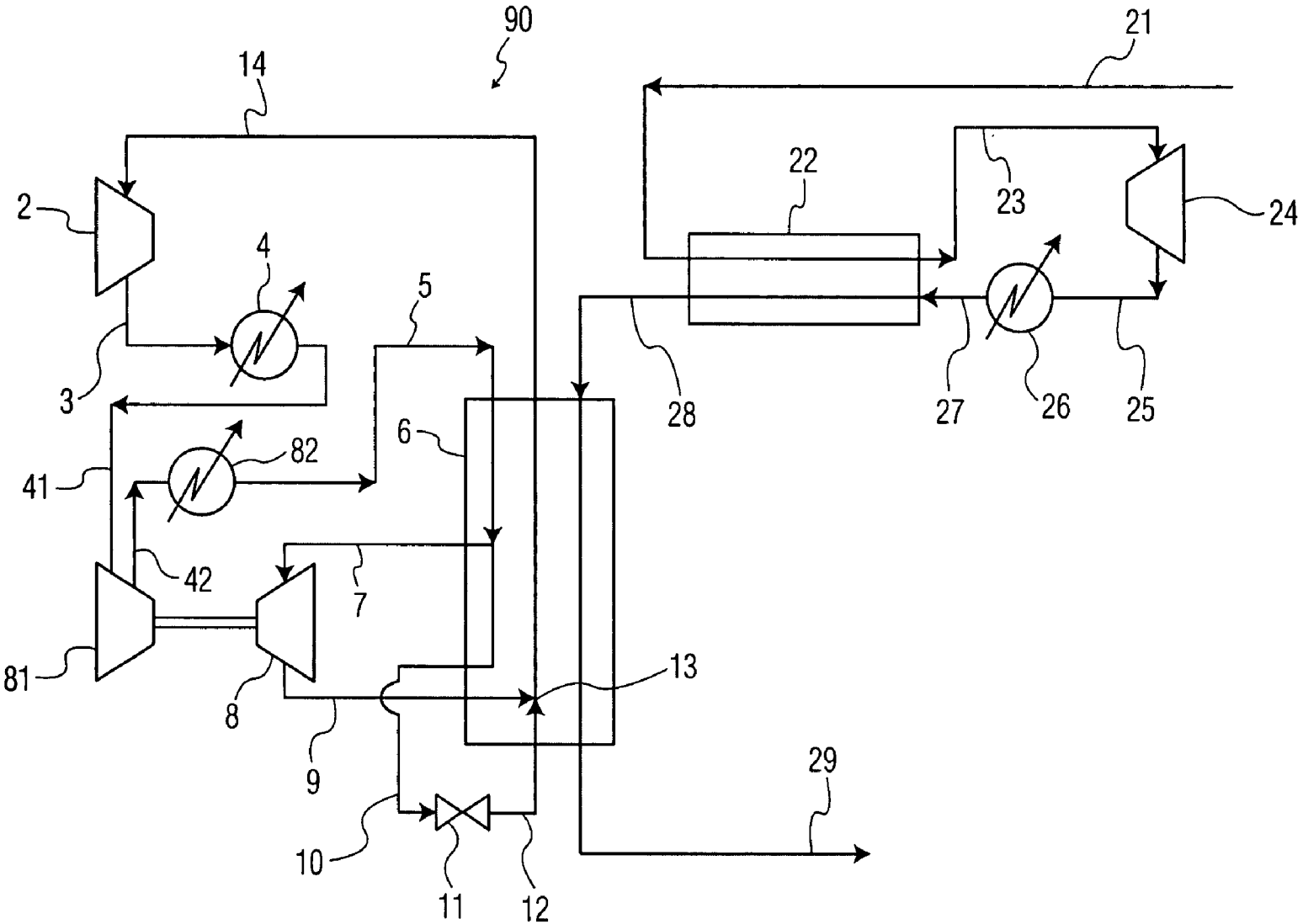
FIG. 5 (which is quantified in the Example) depicts a version of the invention which includes a heat exchanger which recovers boiloff gas refrigeration; a single stage of boiloff gas compression; and a single turboexpander. Turboexpander shaft output drives a compressor, which further elevates the top operating pressure of the closed refrigeration cycle.
Figure 6:
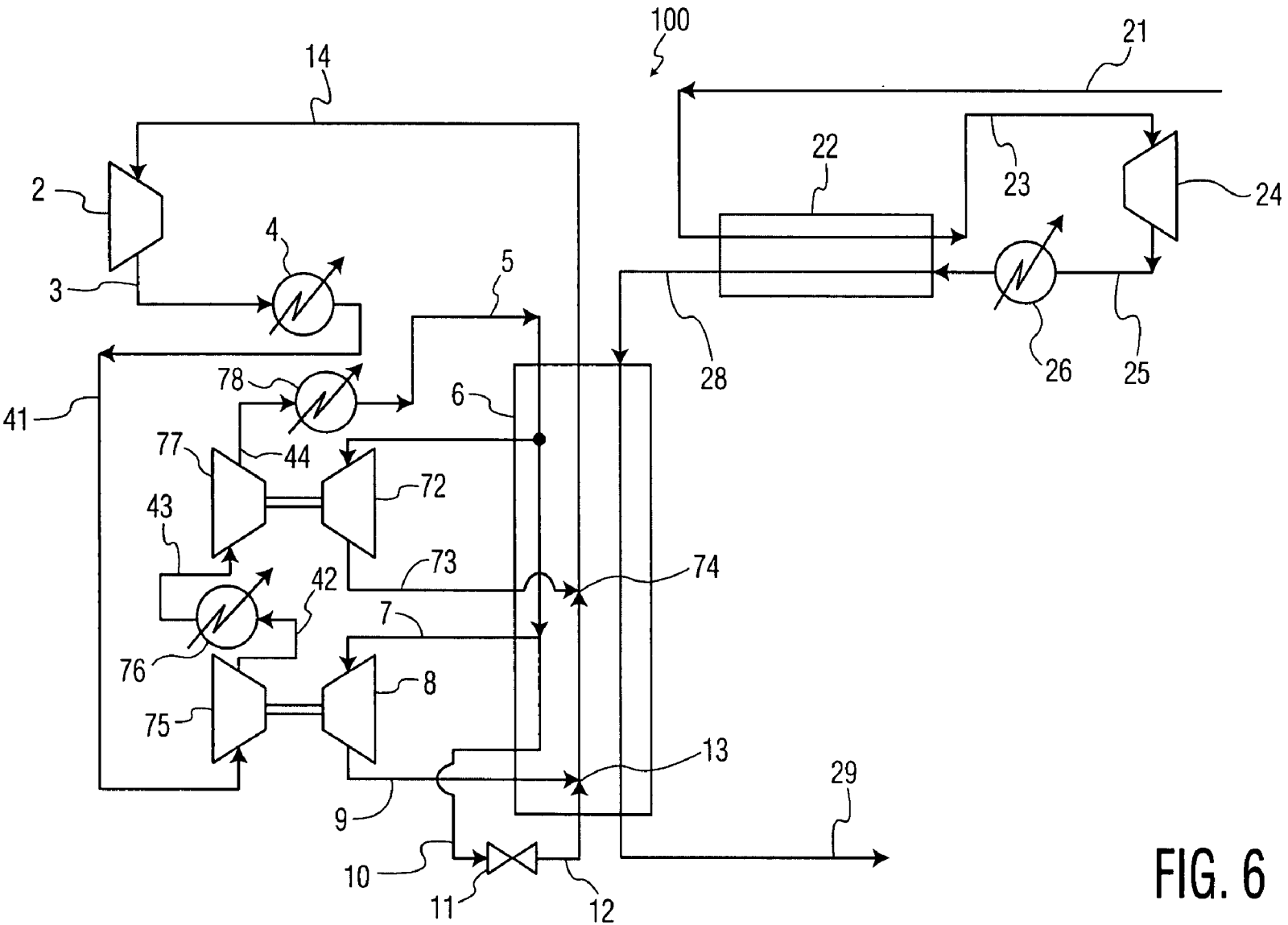
FIG. 6 depicts a version of the invention which includes a heat exchanger which recovers boiloff gas refrigeration; a single stage of boiloff gas compression; and two turboexpander. Turboexpanders shaft outputs drive compressors, which further elevate the top operating pressure of the closed refrigeration cycle. The turboexpanders could also be in a parallel arrangement, operating across the same pressure ratio, instead of dividing the pressure ratio between them. The compressors are shown in a series arrangement. However, they may also be arranged in a parallel arrangement, each operating over the same suction and discharge pressures; or the compressors may operate over the same pressure range as the main refrigeration compressor.

FIGS. 5 and 6 show arrangements similar to FIG. 1 and FIG. 3, respectively, with the exception that the turboexpanders drive compressors. The refrigeration cycle then includes the effects of further compression by these means. The processes represented in FIGS. 2 and 4 could also be modified to include turboexpander-driven compressors as part of the process cycle.

There are a large number of combinations of how turboexpander-driven compressors are employed in a refrigeration cycle. The common element in each of the figures is the single-stage centrifugal main refrigeration compressor.

EXAMPLE kgmoles/hr=kilogram moles per hour (flow)
° C.=degrees Celsius (temperature)
bar=bar (absolute pressure)
composition %=molar percentages FIG. 5 shows a process for the reliquefaction of boiloff gas 21 evolved from the cargo tanks of an ocean-going LNG transport vessel, where the boiloff gas evolution rate is 395.9 kgmoles/hr, reaching the deck at a temperature of −130° C. and a pressure of 1.060 bar. The boiloff gas composition is 91.46% methane; 8.53% nitrogen; and 0.01% ethane. The boiloff gas is warmed in heat exchanger 22 and stream 23 exits at 41° C. and 1.03 bar. Stream 23 enters boiloff gas compressor 24 and is compressed to 2.3 bar and 122° C. Stream 25 is cooled in aftercooler 26 to 43° C. and 2.2 bar. Typically, cooling water is the cooling medium in indirect heat transfer with the boiloff gas for this aftercooler and other aftercoolers in the process. The cooled, compressed gas 27 enters heat exchanger 22 in indirect heat transfer with stream 21, and exits as stream 28 at −126.7° C. and 2.17 bar. Stream 27 enters heat exchanger 6 for further cooling, condensation, and subcooling. Stream 29 exits heat exchanger 6 at −169.2° C. and 2.02 bar. It then can be re-injected into the storage tank.

The refrigeration cycle working fluid in this case is nitrogen. A nitrogen stream 3 at 8.73 bar and 43.12° C. is compressed in a single-stage compressor 2 to 16.64 bar and 123.1° C. at a flow rate of 6875 kgmoles/hr. This stream is cooled in aftercooler 4 to 43° C. and 16.50 bar. Stream 41 is further compressed in turboexpander-driven compressor 81 to 18.99 bar and 59.53° C. Stream 42 cooled in aftercooler 82 to 43.0° C. and 18.89 bar, and stream 5 enters heat exchanger 6, where it is cooled to −142.0° C. A division of nitrogen flow occurs here. Stream 7 is routed to turboexpander 8 at a flow of 6825 kgmoles/hr. The balance of the flow of 50 kgmoles/hr remains in heat exchanger 6 and is cooled to −163.0° C. and 18.49 bar and exits as stream 10.

Stream 10 is valve-throttled to 9.00 bar which produces a two-phase mixture 12 at a temperature of −171.0° C., which enters the cold end of heat exchanger 6 and is vaporized and warmed as it further removes heat from the boiloff gas stream.

Stream 7 undergoes a work-producing turboexpansion which is utilized to drive compressor 81. The discharged stream 9 is at −167.7° C. and 8.99 bar. This stream enters heat exchanger 6 at a point where the returning cold stream is at that temperature. The returning streams may be combined as they are warmed to 42.19° C. and 8.73 bar leaving the heat exchanger as stream 14, transferring their refrigerative value to the incoming streams.

Stream 14 enters the suction side of the single-stage compressor 2 as part of the closed refrigeration cycle.

While particular embodiments of this invention have been described, it will be understood, of course, that the invention is not limited thereto, since many obvious modifications can be made; and it is intended to include with this invention any such modifications as will fall within the scope of the invention as defined by the appended claims.

I claim:

1. A process for reliquefaction of boiloff gas from a liquefied natural gas storage container, comprising the steps of:

compressing a refrigerant in only one single stage main compressor to yield a compressed refrigerant;

passing the compressed refrigerant from the only one single stage main compressor through a first aftercooler for cooling to a first temperature;

passing the cooled refrigerant from the first aftercooler through a first flow path of a first heat exchanger for further cooling to a second temperature lower than said first temperature;

withdrawing a first portion of said refrigerant at said second temperature from the first flow path of said first heat exchanger;

passing the first portion of said refrigerant through a first turboexpander for cooling to a third temperature lower than said second temperature;

passing the refrigerant from said first turboexpander through a second flow path of the first heat exchanger in a direction countercurrent to the refrigerant flowing through the first flow path of said first heat exchanger;

compressing a boiloff gas from a liquefied natural gas storage container through a boiloff compressor to a desired pressure; and passing the compressed boiloff gas from the boiloff compressor through a third flow path of the first heat exchanger in a direction countercurrent to the refrigerant flowing through said second flow path thereof, for cooling to a temperature sufficient to achieve liquefaction thereof.

2. The process of claim 1, prior to the step of compressing the boiloff gas, further comprising the steps of:

warming the boiloff gas by passing it through a first flow path of a second heat exchanger for recovering the refrigerative value therefrom, prior to compressing the boiloff gas in the boiloff compressor;

cooling the boiloff gas through a boiloff aftercooler after compressing the boiloff gas in the boiloff compressor; and passing the cooled boiloff gas from the boiloff aftercooler through a second flow path of said second heat exchanger in a direction countercurrent to the boiloff gas flowing through the first flow path for imparting thereto the refrigerative value recovered from the boiloff gas passing through the first flow path.

3. The process of claim 1, further comprising the steps of:

passing the remaining portion of said refrigerant from the first flow path of said first heat exchanger through a throttle valve, for equalizing the pressure of said refrigerant to the pressure of the refrigerant exiting said first turboexpander; and passing the refrigerant from said throttle valve, in combination with the refrigerant from said first turboexpander, through the second flow path of said first heat exchanger.

4. The process of claim 1, wherein the first turboexpander is adapted to drive a device selected from the group consisting of a compressor, an electric generator, a mechanical load, a dissipative brake and combinations thereof.

5. The process of claim 1, further comprising:

withdrawing a second portion of said refrigerant from the first flow path of said first heat exchanger;

passing the withdrawn second portion of said refrigerant through a second turboexpander for further cooling; and passing the refrigerant from said second turboexpander, in combination with the refrigerant from both said first turboexpander and said throttle valve, through the second flow path of said first heat exchanger.

6. The process of claim 5, wherein at least one of the first and second turboexpanders is adapted to drive a device selected from the group consisting of a compressor, an electric generator, a mechanical load, a dissipative brake and combinations thereof.

7. The process of claim 5, prior to the step of passing the refrigerant through the first flow path of the first heat exchanger, further comprises the steps of:

passing the cooled refrigerant from the first aftercooler through a first refrigerant compressor driven by at least one of the first and second turboexpanders;

passing the compressed refrigerant from the first refrigerant compressor through a second aftercooler;

passing the cooled refrigerant from the second aftercooler through a second refrigerant compressor driven by the other of the first and second turboexpanders; and passing the compressed refrigerant from the second refrigerant compressor through a third aftercooler immediately prior to passage through the first flow path of the first heat exchanger.

* * * * *